US006776713B2

(12) United States Patent
Gauselmann

(10) Patent No.: US 6,776,713 B2
(45) Date of Patent: Aug. 17, 2004

(54) GAME FOR A GAMING DEVICE WHERE A PLAYER COMPETES WITH A COMPUTER

(75) Inventor: Michael Gauselmann, Espelkamp (DE)

(73) Assignee: Atronic International GmbH (DE)

( * ) Notice: Subject to any disclaimer, the term of this patent is extended or adjusted under 35 U.S.C. 154(b) by 0 days.

(21) Appl. No.: 10/306,150

(22) Filed: Nov. 26, 2002

(65) Prior Publication Data

US 2004/0102240 A1 May 27, 2004

(51) Int. Cl.[7] ..... A63F 9/24
(52) U.S. Cl. ..... 463/16; 273/139
(58) Field of Search ..... 463/1, 16, 25, 463/30, 31, 37, 42, 19–20; 273/138.1, 139, 288, 271, 264, 236

(56) References Cited

U.S. PATENT DOCUMENTS 4,275,442 A * 6/1981 Underwood et al. ..... 463/9
5,465,982 A * 11/1995 Rebane ..... 463/9
6,155,566 A * 12/2000 Benatti ..... 273/263
6,354,939 B1 * 3/2002 Morita et al. ..... 463/1
6,378,867 B1 * 4/2002 Shalless ..... 273/240
2002/0082071 A1 * 6/2002 Riendeau et al. ..... 463/16

* cited by examiner

*Primary Examiner*—Kim Nguyen
(74) *Attorney, Agent, or Firm*—Patent Law Group LLP; Brian D. Ogonowsky

(57) ABSTRACT

In one embodiment of the invention, a game involves the player playing against a gaming machine's computer such that a victory by the player in the game grants an award to the player. In one particular game, the player and computer compete to build a structure created from objects. The player and computer alternate turns. The player chooses from a number of icons, each representing a hidden object, with the hope of choosing the tallest object, and the computer randomly selects an object. The player attempts to build a structure above a winning height before the computer's structure reaches the winning height. Along the way, the player is given various options, such as the option to change positions with the computer, the option to buy an object, or other types of options. In another embodiment, instead of the player playing against the computer, if the gaming machine is connected to a network with other gaming machines, multiple players may play against each other, and the player with the best result wins a special award.

19 Claims, 4 Drawing Sheets

GAME FOR A GAMING DEVICE WHERE A PLAYER COMPETES WITH A COMPUTER

FIELD OF THE INVENTION

This invention relates to gaming machines and, in particular, to a main game or a bonus game conducted by a video-type gaming machine.

BACKGROUND

Video gaming machines that randomly select symbols for display on the video screen and grant awards to a player based upon the displayed symbol combinations are very popular. Typically, the game ends after the display of the symbols, and the player must then bet more credits in order to play again. The symbols may form a 3×1 array, having three symbols in a single row, or the display may be a two dimensional array of symbols having, for example, three rows of symbols in five columns. The granting of an award is based on the symbol combinations across pay lines extending across the array of symbols.

Although the above-described gaming machines are popular, it is desirable to create a game that achieves more player excitement to generate more revenue by the gaming machine.

SUMMARY

In one embodiment of the invention, an initial game is first played on a video gaming machine, where an array of symbols is randomly selected and displayed, and an award is granted based on any winning symbol combinations across activated pay lines. If the player gets a special bonus combination or other triggering event, a secondary game is activated that allows the player to win additional awards. The secondary game involves the player playing against the gaming machine's computer such that a victory by the player in the secondary game grants an additional award to the player.

In one particular game, the player and computer compete to build a structure created from objects, such as blocks. The player and computer alternate turns. The player chooses from a number of icons, each representing a hidden object, with the hope of choosing the tallest object, and the computer randomly selects an object. The player attempts to build a structure above a winning height before the computer's structure reaches the winning height. Along the way, the player is given various options, such as the option to change positions with the computer, the option to buy an object, or other types of options.

The invention is not limited to building a structure but may be applied to any type of game where the player competes with the computer, and the player makes decisions during the game to affect the outcome.

In another embodiment, instead of the player playing against the computer, if the gaming machine is connected to a network with other gaming machines, multiple players may play against each other, and the player with the best result wins a special award.

The games described herein may be bonus games or may be the main game played on a video gaming machine.

DETAILED DESCRIPTION

Although the invention can typically be implemented by installing a software program in most types of modern video gaming machines, one particular gaming machine platform will be described in detail.

Figure 1:
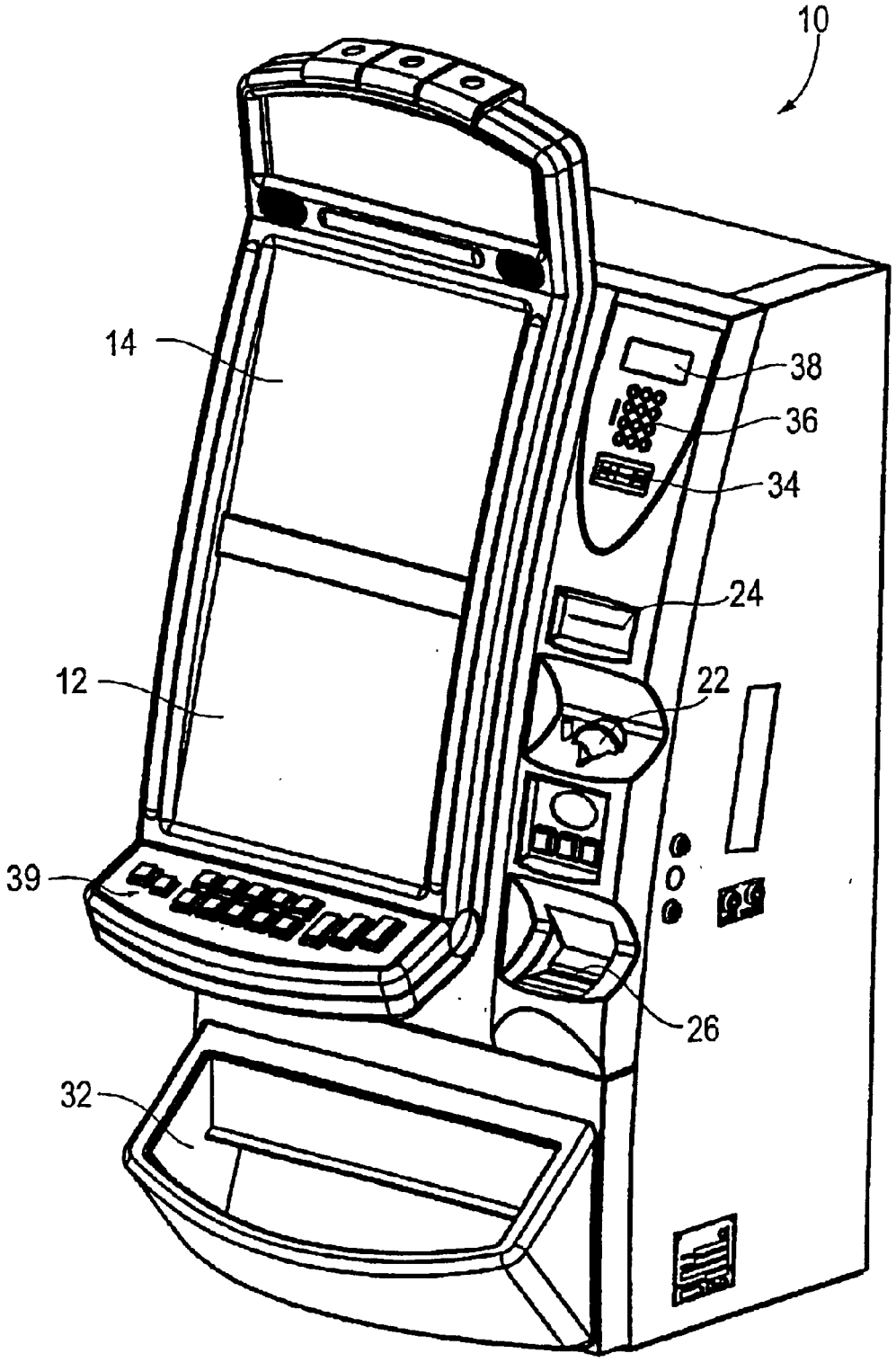
FIG. 1 is a perspective view of one type of video gaming machine that may be programmed to play the games in accordance with the present invention.

FIG. 1 is a perspective view of a gaming machine 10 that incorporates the present invention. Machine 10 includes a display 12 that may be a thin film transistor (TFT) display, a liquid crystal display (LCD), a cathode ray tube (CRT), or any other type of display. Display 12 may be a touch screen for inputting player commands. A second display 14 provides game data or other information in addition to display 12. Display 14 may provide static information, such as an advertisement for the game, the rules of the game, pay tables, pay lines, or other information, or may even display the game itself along with display 12. Alternatively, the area for display 14 may be a display glass for conveying information about the game.

A coin slot 22 accepts coins or tokens in one or more denominations to generate credits within machine 10 for playing games. A slot 24 for an optical reader and printer receives machine readable printed tickets and outputs printed tickets for use in cashless gaming. A bill acceptor 26 accepts various denominations of banknotes.

A coin tray 32 receives coins or tokens from a hopper upon a win or upon the player cashing out.

A card reader slot 34 accepts any of various types of cards, such as smart cards, magnetic strip cards, or other types of cards conveying machine readable information. The card reader reads the inserted card for player and credit information for cashless gaming. The card reader may also include an optical reader and printer for reading and printing coded barcodes and other information on a paper ticket.

A keypad 36 accepts player input, such as a personal identification number (PIN) or any other player information. A display 38 above keypad 36 displays a menu for instructions and other information and provides visual feedback of the keys pressed.

Player control buttons 39 include any buttons needed for the play of the particular game or games offered by machine 10 including, for example, a bet button, a repeat bet button, a play two-ways button, a spin reels button, a maximum bet button, a cash-out button, a display pay lines button, a display payout tables button, select icon buttons, and any other suitable button. Buttons 39 may be replaced by (or be in addition to) a touch screen with virtual buttons, a joystick, a touchpad, or other types of controllers.

Figure 2:
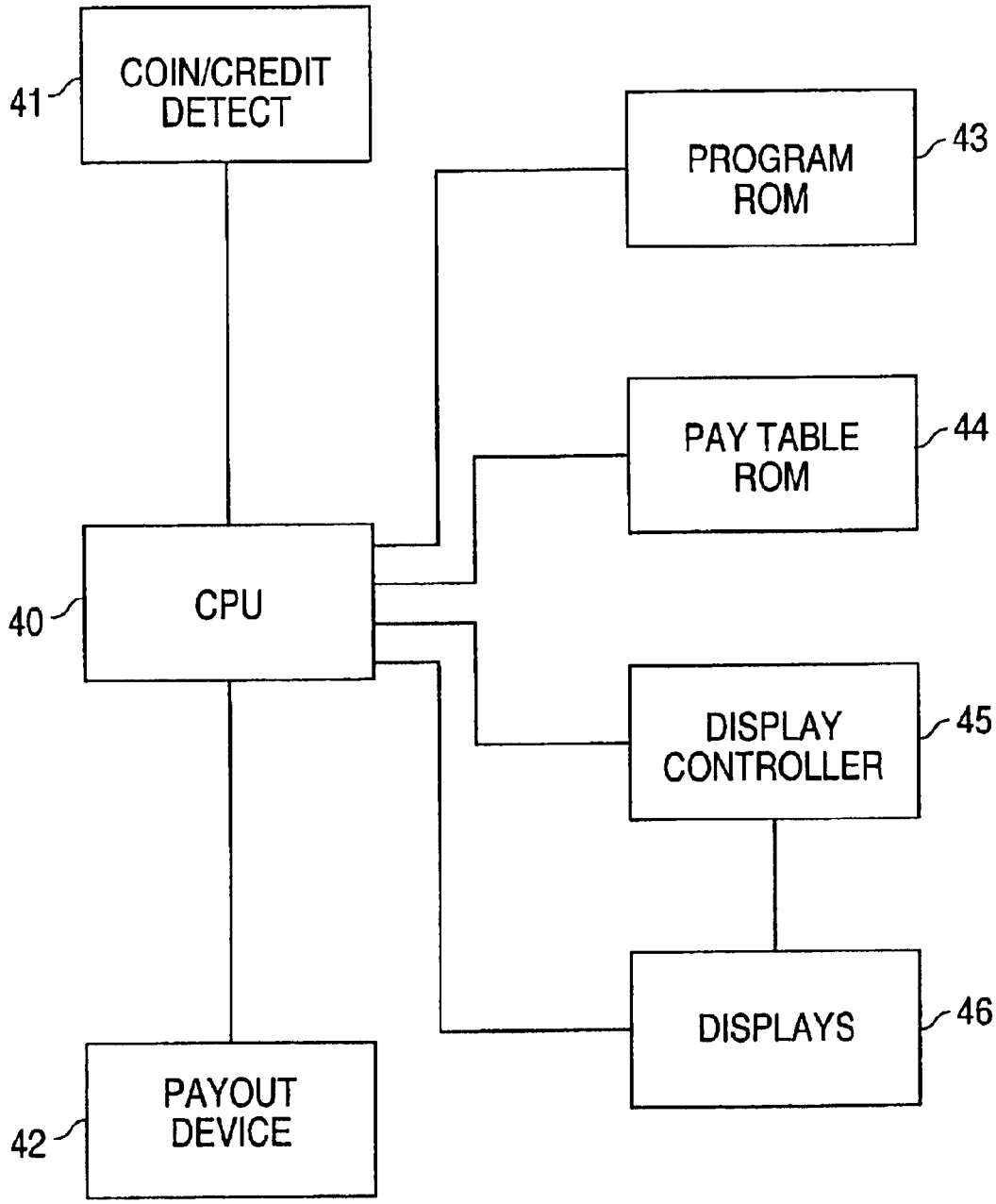
FIG. 2 is a block diagram illustrating various functional units in the machine of FIG. 1.

FIG. 2 illustrates basic circuit blocks in a suitable gaming device. A control unit (CPU 40) runs a gaming program stored in a program ROM 43. A coin/credit detector 41 enables the CPU 40 to initiate a next game. A pay table ROM 44 detects the outcome of the game and identifies awards to be paid to the player. A payout device 42 pays out an award to the player in the form of coins upon termination of the game or upon the player cashing out. A payout may also be in the form of a coded paper ticket, credits on a smart card or magnetic strip card, or in any other form. A display controller 45 receives commands from the CPU 40 and generates signals for the various displays 46. If a display 46 is a touch screen, player commands may be input through the display screen into the CPU 40.

After the player makes a bet and presses a spin button, symbols are randomly selected by a pseudo-random number generator in the gaming machine (e.g., the CPU 40 carrying out a random number generating program) and displayed on the display screen. The gaming machine typically shows, either on its display glass or on a video screen, a pay table identifying the various awards that will be paid upon obtaining certain symbol combinations along activated pay lines. The player may be required to bet additional credits to activate additional pay lines.

After the initial display of the symbol array, the player is awarded credits or paid coins based on any winning symbol combinations across activated pay lines, in accordance with the pay table. In another embodiment, the award to the player is postponed until after the secondary game, described below.

The secondary game may be activated by the player betting a maximum bet, or activated by the player wagering additional amounts, or activated by the player getting a certain winning symbol combination or trigger symbol in the initial game, or activated after each game. Other activating events may also be used. For example, the secondary game may be activated after a non-winning game to provide the player another possibility for a win.

In another embodiment, the games described below are the main games played on the gaming machine without any initial game to initiate the secondary game. However, for purposes of this disclosure, it will be assume that the games described below are secondary games pursuant to any of the triggering events mentioned above.

Assuming a secondary game is activated, the player is now allowed to play the secondary game. The secondary game involves the player making choices by selecting hidden objects to build a structure, a person, a number, or anything else. The computer randomly makes selections to compete with the player toward a common goal. During this process, the player may be offered various options that will affect the outcome of the game.

FIGS. 3–6 illustrate one of the many types of games that may be played. In the game of FIGS. 3–6, the goal is to be the first to build a structure above a winning height labeled "Finish." The icons A, B, C, and D each represent a different block having a certain height. The player selects an icon with the hope of choosing the tallest block. The hidden blocks may change prior to the computer's turn or may stay the same for the computer's turn. After each round, the hidden blocks change. The selections can be with or without replacement. "With replacement" means that if a particular block is selected, that block is replaced so as to possibly be chosen again. "Without replacement" means a selected block may not be chosen again.

Figure 3:
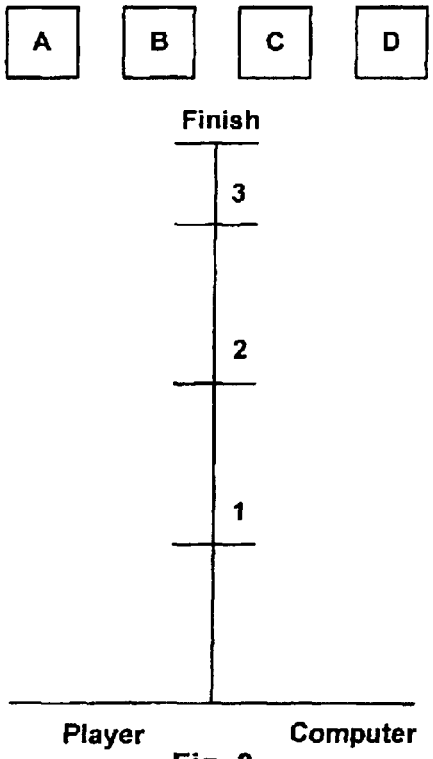
FIG. 3 illustrates a display on the display screen in FIG. 1 at the beginning of the secondary game.
Figure 4:
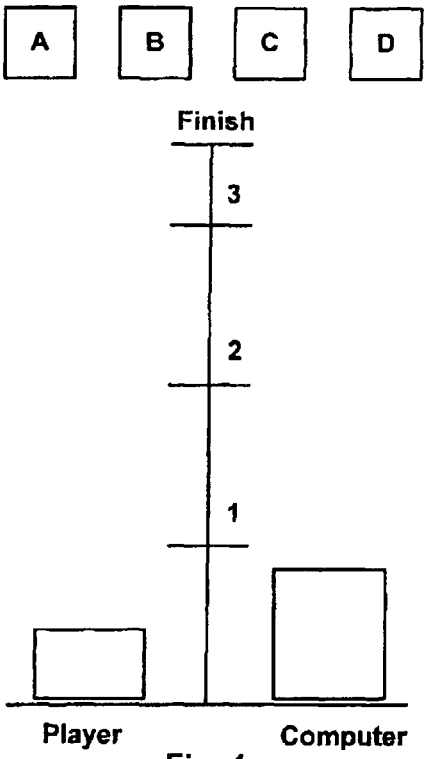
FIG. 4 illustrates the display after the player and the computer have made their first selections.

Presented with the display of FIG. 3, the player selects, for example, the icon C by either touching the icon on a touch screen or pressing the appropriate button. FIG. 4 illustrates that the selection of the icon C resulted in the block shown on the player's side. The computer then randomly selects one of the icons A–D, which results in the taller block shown on the computer side.

Figure 5:
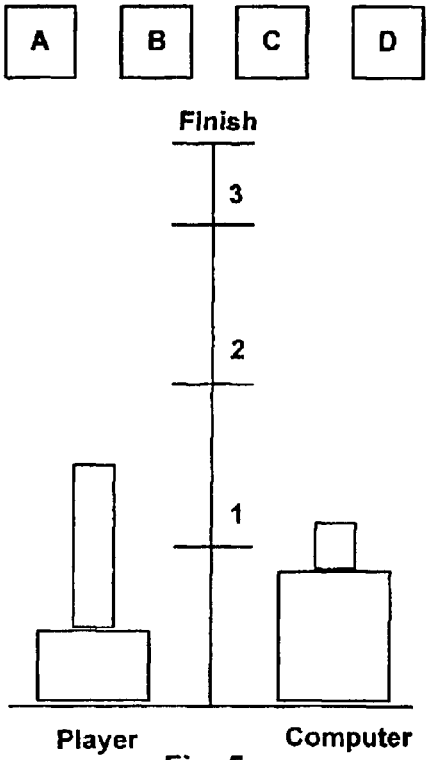
FIG. 5 illustrates the display after the player and computer have made their second selections.

The player then makes another selection of one of the icons A–D, and the computer also makes its selection, resulting in the display of FIG. 5.

Figure 6:
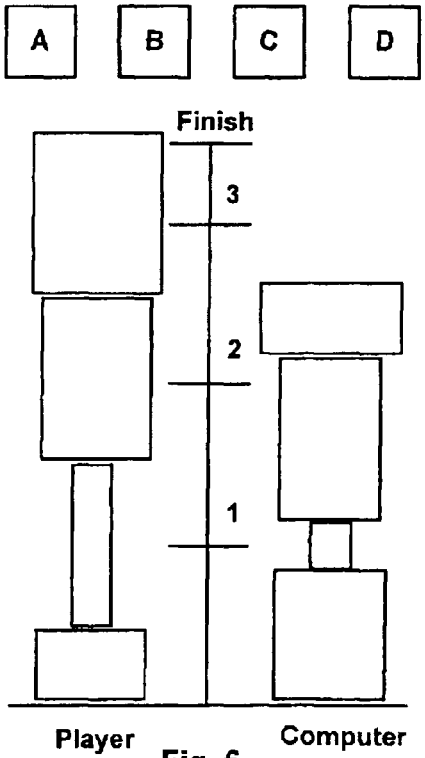
FIG. 6 illustrates the display after the player has made four selections and won the secondary game by building a structure above a winning height.

FIG. 6 illustrates the display after two more turns, where the player has built a structure that exceeded the Finish line, ending the game and resulting in a special award to the player.

During the game, at various intervals, such as after the player's structure has exceeded each height level 1, 2, and 3, options are presented by the machine to the player which the player may accept, reject, or make other decisions about. For example, in FIG. 5, the player's second block has exceeded the event height 1. At this time, the player may then be given any one or more of the following example options:

a. change positions with the computer;
b. cause the height of the computer's structure to increase or decrease an unknown amount;
c. exchange the player's last block with the block to be selected by the computer;
d. rotate one of the blocks 90, 180, or 270 degrees;
e. select an award multiplier from a plurality of hidden multipliers;
f. cause the last drawn symbol of either side to be added at one side;
g. buy a block according to a variable price list;
h. sell objects (e.g., blocks) to the computer;
i. change the goal of the game, such as by changing the goal from building the tallest structure to building the shortest structure.

The one or more options may change at each of the three critical event levels or may stay the same. The machine may randomly offer the player an option, or the options may be offered based on other factors.

In one embodiment, once an option is selected, it cannot be later chosen in the game. This adds strategy to the game.

The building of a structure may be applied to building a person (such as a clown), a house, a ship, a monument, a tree, a cake, a numerical value, or anything else. For building a person, each object may comprise a portion of a person, such as feet, legs, arms, head, etc.

Figure 7:
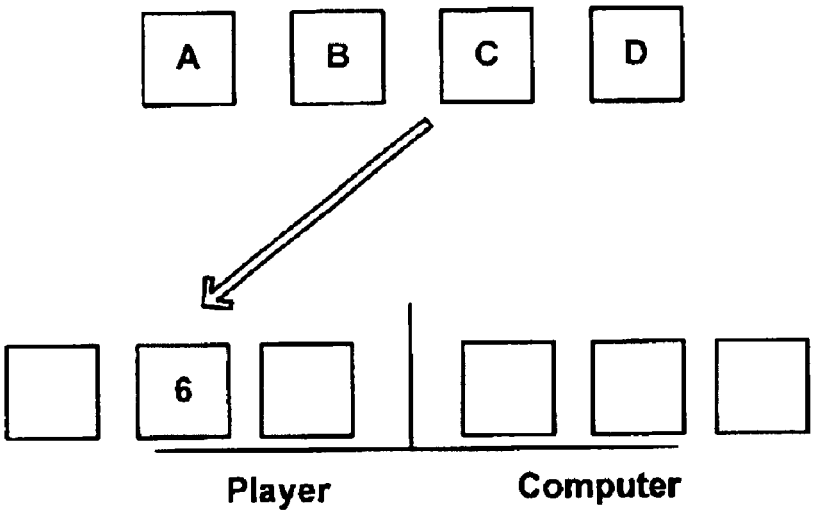
FIG. 7 illustrates a display of a different type of a secondary game where the player and the computer choose hidden digits in order to create the highest numerical value.
Figure 8:
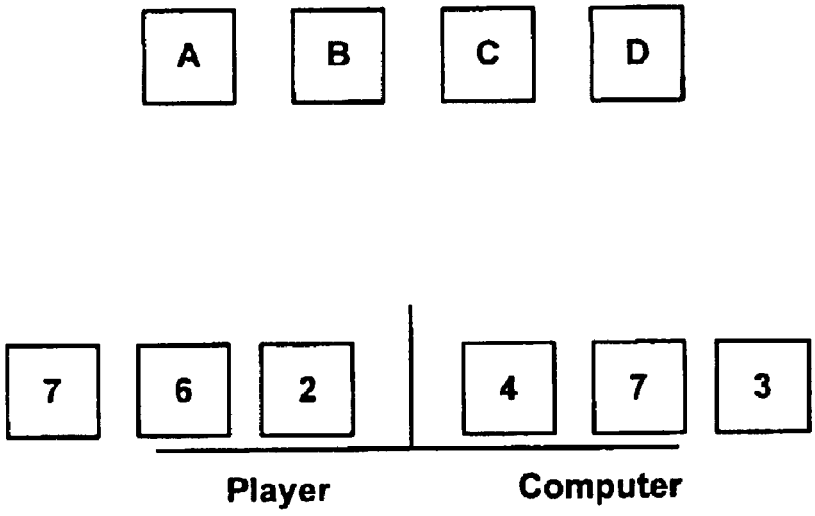
FIG. 8 illustrates the display after the game of FIG. 7 has been completed, showing that the player has won by creating a higher number than the computer.

FIGS. 7 and 8 illustrate a secondary game where the player builds a 3-digit numerical value. In FIG. 7, the player has chosen the icon C, which is then reveal to the player as the number 6. The player then selects, using a touch screen, one of the three positions in which to place the number in order to maximize a 3-digit numerical value. In the example of FIG. 7, the player has chosen the 6 to be in the second position. The computer then selects an icon and a position for the computer's selected number.

This process goes on for three rounds until both the player and computer have built a 3-digit numeral. The numeral may be with or without replacement. The goal is for the player to beat the computer with a higher 3-digit numeral in order to win an award. The amount of the award may be based upon the numeric value built by the player or may be a predetermined amount. In another embodiment, the award to the player is only based upon the numerical value built by the player and not based upon whether the player has beaten the computer.

At various stages of the game of FIGS. 7 and 8, such as after each pick, the player is offered various options, such as whether to switch positions with the computer or any of the other options described above so as to provide additional levels of interaction with the player.

In another embodiment, instead of the player and computer selecting icons with hidden values or objects, the player and computer may select directions for moving an object in a maze in order to achieve a certain goal, such as collecting awards in the maze or finishing the maze.

Other games may also be played against the computer. In one such game, blocks descend, and the player rotates the blocks to fit together. In another game, the player must build something, such as a clown, a building, or a numeral, that is smaller than the one built by the computer.

The computer may go first or last during each round. Many other types of games may be played against the computer.

In another embodiment, multiple gaming machines are connected in a network. Instead of the players individually playing against the computer in their own gaming machine, the players compete with each other in games similar to those described with respect to FIGS. 2–8 but with multiple opponents. Such a network game may be a tournament.

At certain critical events or after each round, each player is given one or more options and has to make a decision, as described above. If the players are playing a digit-building game described with respect to FIGS. 7 and 8, the award could be directly correlated to the number built by the winning player. Alternatively, the winning player may win the top award of the bonus round, the player with the second highest number may win a lower award, and so on.

The secondary game may be played on either the upper display screen or the lower display screen in FIG. 1. If the game is being played by multiple players, the current results for all the players may be shown on the top screen while the bottom screen may be used for the individual player's inputs.

In another embodiment with multiple players, the players compete with each other and against the computer. A high award is given to the player with the best results with at least some award being granted to all the players who had beaten the computer.

Different players may have different goals, which may be known or unknown to each other, and may trade parts. Even though the player does not win the contest, she may end up with more credits than other players because of clever trading. The player may keep the credits exceeding a certain value (e.g., above the starting value or above the mean value). The player may be allowed to use credits from the base game to trade during the secondary game. The number of credits wagered may be unrestricted or up to a certain amount.

The invention may be implemented in a stand-along gaming machine, a gaming machine connected to a central server, a personal computer, a computer conducting on-line gaming, or in any other device.

Having described the invention in detail, those skilled in the art will appreciate that, given the present disclosure, modifications may be made to the invention without departing from the spirit of the inventive concepts described herein. Therefore, it is not intended that the scope of the invention be limited to the specific embodiments illustrated and described.

What is claimed is:

1. A gaming method performed by a gaming device comprising:

a. displaying a plurality of hidden choices, in a first position on a display, to a player for selection of at least one by the player;

b. receiving signals from a player input device to designate a player-selected choice to play a game;

c. implementing the player-selected choice by revealing and moving the player-selected choice to a second position on the display;

d. selecting by a computer a computer-selected choice;

e. implementing the computer-selected choice by revealing and moving the computer-selected choice to a third position on the display;

f. repeating steps a–e until the game has finished; and g. granting a monetary award to the player base on an outcome of the game, the outcome of the game being based on the arrangements of the player-selected choices and the computer-selected choices.

2. The method of claim 1 further comprising:

providing the player at least one known option, in addition to the hidden choices, upon the player achieving certain criteria during play of the game;

receiving signals from the player input device to designate the selection of the option; and implementing the option selected.

3. The method of claim 2 wherein the at least one known option comprises changing positions with the computer.

4. The method of claim 2 wherein the hidden choices comprise objects for stacking on one another, wherein the at least one known option comprises changing positions with the computer.

5. The method of claim 2 wherein the hidden choices comprise objects for stacking on one another, wherein the at least one known option comprises changing a height of a stack of objects created by the computer.

6. The method of claim 2 wherein the hidden choices comprise objects for stacking on one another, wherein the at least one known option comprises exchanging one object in the player's stack of objects with one object in the computer's stack of objects.

7. The method of claim 2 wherein the hidden choices comprise objects for stacking on one another, wherein the at least one known option comprises allowing the player to buy a particular object.

8. The method of claim 2 wherein the at least one known option comprises an award multiplier.

9. The method of claim 2 wherein once an option is selected by the player, the option cannot be again selected by the player during the game.

10. The method of claim 2 wherein the player is required by the gaining device to select one of the at least one known option provided to the player.

11. The method of claim 1 wherein the hidden choices comprise objects for stacking on one another.

12. The method of claim 11 wherein the objects vary in size, and the game comprises stacking the objects to a certain height.

13. The method of claim 11 wherein the objects comprise blocks.

14. The method of claim 11 wherein the objects comprise parts of a person.

15. The method of claim 1 wherein the hidden choices comprise digits for creating a multi-digit number.

16. The method of claim 15 wherein granting a monetary award comprises granting a monetary award relating to the multi-digit number formed.

17. The method of claim 1 wherein the game is a secondary game played after a main game.

18. The method of claim 1 wherein the player makes a player-selected choice before the computer makes the computer-selected choice for each turn.

19. A gaming device comprising:

a display for displaying a game; and at least one processor for carrying out the following method:

a. displaying a plurality of hidden choices, in a first position on the display, to a player for selection of at least one by the player;

b. receiving signals from a player input device to designate a player-selected choice to play the game;

c. implementing the player-selected choice by revealing and moving the player-selected choice to a second position on the display;

d. selecting by a computer a computer-selected choice;

e. implementing the computer-selected choice by revealing and moving the computer-selected choice to a third position on the display;

f. repeating steps a–e until the game has finished; and g. granting a monetary award to the player base on an outcome of the game, the outcome of the game being based on the arrangements of the player-selected choices and the computer-selected choices.

* * * * *